US006957500B2

(12) United States Patent
McCambridge et al.

(10) Patent No.: US 6,957,500 B2
(45) Date of Patent: Oct. 25, 2005

(54) ATTACHMENT FOR HANDHELD DRYER

(75) Inventors: James E. McCambridge, Polo, IL (US); Scott A. Melton, Erie, IL (US); Luther D. Langley, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 138 days.

(21) Appl. No.: 10/286,592

(22) Filed: Nov. 1, 2002

(65) Prior Publication Data

US 2004/0083620 A1 May 6, 2004

(51) Int. Cl.[7] ..... A45D 20/10

(52) U.S. Cl. ..... 34/96; 34/97; 392/383; 392/384; 392/385; 239/291; 239/590

(58) Field of Search ..... 34/97, 98, 99, 34/96; 392/379, 380, 383, 384, 385; 239/290, 291, 589, 590

(56) References Cited

U.S. PATENT DOCUMENTS

| | | | | | |
|---|---|---|---|---|---|
| 3,943,329 | A | * | 3/1976 | Hlavac | 392/379 |
| 4,391,047 | A | * | 7/1983 | Janssens et al. | 34/97 |
| 4,815,219 | A | * | 3/1989 | Binger | 34/443 |
| 4,848,007 | A | | 7/1989 | Montagnino | 34/97 |
| 4,928,402 | A | | 5/1990 | Allen | 34/97 |
| 4,972,065 | A | | 11/1990 | Ohlsen | 392/380 |
| 5,317,815 | A | * | 6/1994 | Hwang | 34/97 |
| 5,649,370 | A | * | 7/1997 | Russo | 34/97 |
| 5,841,943 | A | * | 11/1998 | Nosenchuck | 392/385 |
| D432,717 | S | | 10/2000 | Micinilio et al. | D28/13 |
| 2003/0079366 | A1 | | 5/2003 | Chang | |

FOREIGN PATENT DOCUMENTS

| | | |
|---|---|---|
| EP | 0439781 A1 | 8/1991 |
| GB | 2067097 A | 7/1981 |
| JP | 06327514 | 11/1993 |

* cited by examiner

*Primary Examiner*—Henry Bennett
*Assistant Examiner*—Camtu Nguyen
(74) *Attorney, Agent, or Firm*—Greer, Burns & Crain, Ltd.

(57) ABSTRACT

An attachment for a handheld dryer includes a shell and a dryer barrel-receiving portion. A first passage is defined between the shell and the dryer and terminates in a shell inlet defined between the shell and the dryer barrel. The present attachment may be useful to increase volumetric flow and/or velocity of flow from a handheld dryer.

22 Claims, 10 Drawing Sheets

ATTACHMENT FOR HANDHELD DRYER

BACKGROUND OF THE INVENTION

The present invention is related to handheld dryer devices such as hair dryers and the like, as well as to attachments for handheld dryers.

Handheld dryers such as hair dryers are generally known in the art. Typically they include a housing having an interior, a handle, and a barrel. An impeller is enclosed in the housing for forcing air at an increased velocity out of the barrel. A heater such as an electric coil is typically contained in the barrel for heating the air as it passes by. In operation, a user such as a hairstylist may direct the barrel in a desired direction to exploit the heated air flowing therethrough to dry the hair of a customer, for example.

Drying occurs as moisture is removed by the heated air. The speed at which a wet object such as hair may be dried generally depends on the capacity of the heated air to absorb moisture and the volumetric flow rate of the heated air contacting the wet object. For general purposes, the capacity of heated air to absorb moisture is determined by its relative humidity and its temperature. Although handheld dryers are generally known, problems and unresolved needs in the art remain. By way of example, the volumetric and velocity output of dryers are generally fixed depending on factors such as the impeller power and speed, the barrel configuration, air inlet size, and the like. This in turn generally limits the drying capability of the dryer.

Some attempts have been made to address these needs. To date, however, these attempts have met with only limited success. For example, some dryers are provided with impellers that are operable at different speeds to provide some variance in output. This disadvantageously adds cost and complexity to the dryer, however. Additionally, the dryer is limited to the impeller speed settings provided, which typically include only two or three speeds. Also, diffuser attachments are known for releasably fastening on the outlet of conventional dryers for diffusing airflow and/or for reducing the velocity of the flow. These attachments have not been useful, however, to provide variable volumetric and/or velocity output.

Also, many prior art diffusers and other attachments disadvantageously increase the back pressure on the dryer motor, thereby taxing the motor. For example, attachment of prior art diffusers to a dryer can cause the RPM of the motor to increase by 6% or more. This tends to lower the efficiency of the motor, to increase utility costs, and to shorten the service life of the dryer.

Accordingly, these and other unresolved needs remain in the art.

SUMMARY OF THE INVENTION

The present invention is directed to attachments for handheld dryers. An exemplary attachment of the invention includes a shell having at least one dryer barrel-receiving member. The preferred embodiment is releaseably attached to the barrel of a conventional dryer using the barrel-receiving member. At least a portion of the shell is coextensive with the barrel. A passage is defined between the shell and the dryer barrel, and communicates with a shell inlet that is defined between the shell and the barrel.

Embodiments of the attachment of the invention offer advantages and are useful to solve otherwise unresolved problems of the prior art. For example, one exemplary attachment of the invention is operable to increase volumetric airflow from a dryer. By way of additional example, a second exemplary attachment of the invention is useful to increase the velocity of air expelled from the hair dryer. These and other advantages of the invention will be better appreciated through consideration of the detailed description of exemplary invention embodiments that follows.

DETAILED DESCRIPTION

Turning now to the drawings, a first exemplary embodiment of an attachment 10 of the invention includes a generally tubular shell 12 connected to a plurality of spaced apart elongated fins 14 that are adapted to frictionally receive and engage the barrel of a handheld dryer. As used herein, the term "tubular" is intended to broadly refer to a shape including two open ends that are connected by a wall that has a generally circular cross section. The diameter of the tube wall may vary along its length.

Figure 1:
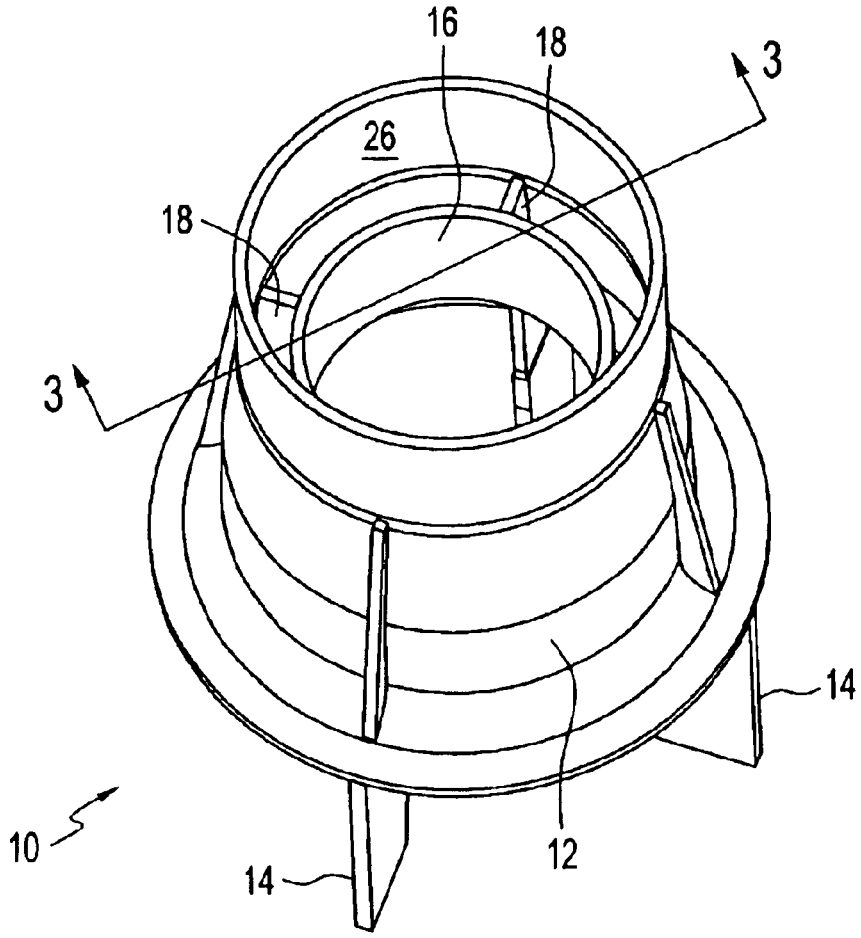
FIG. 1 is a perspective view of a first exemplary attachment of the invention viewed generally from the attachment outlet.
Figure 2:
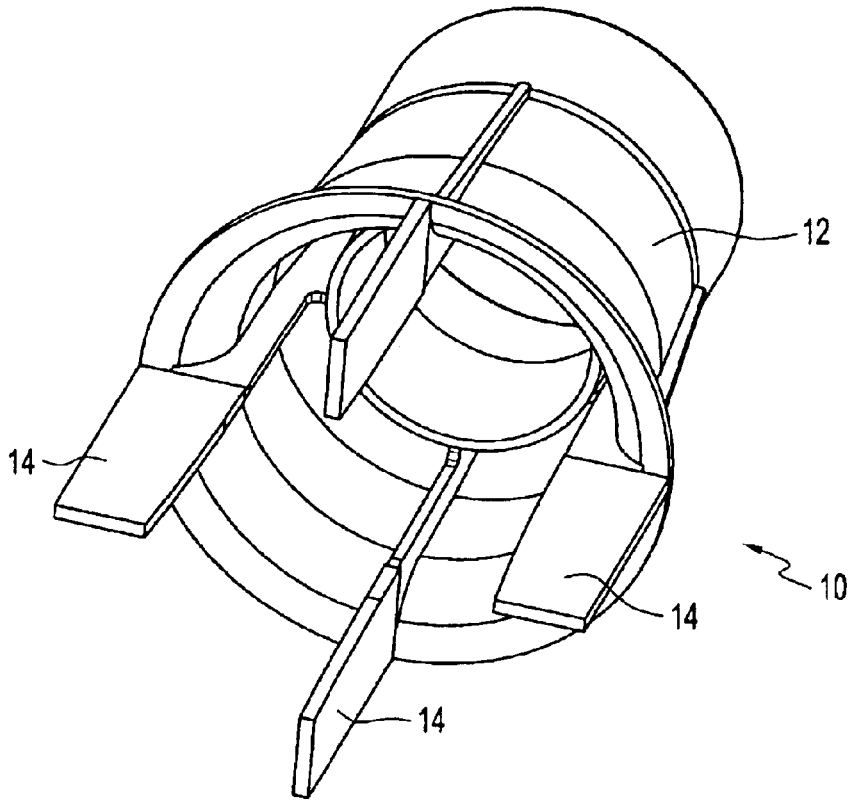
FIG. 2 is a perspective view of the first exemplary attachment of the invention viewed from the attachment inlet.
Figure 4:
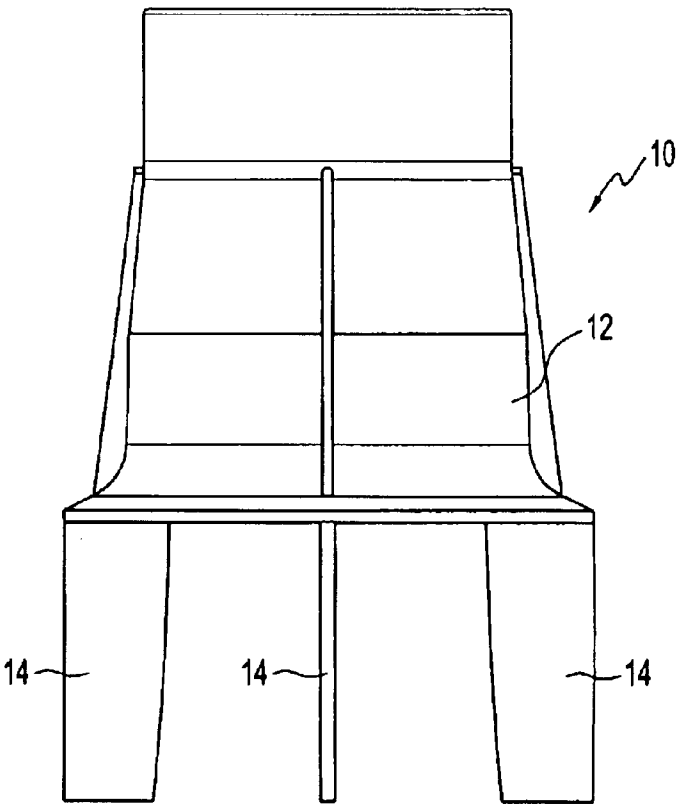
FIG. 4 is a side view of first exemplary attachment of the invention.
Figure 3:
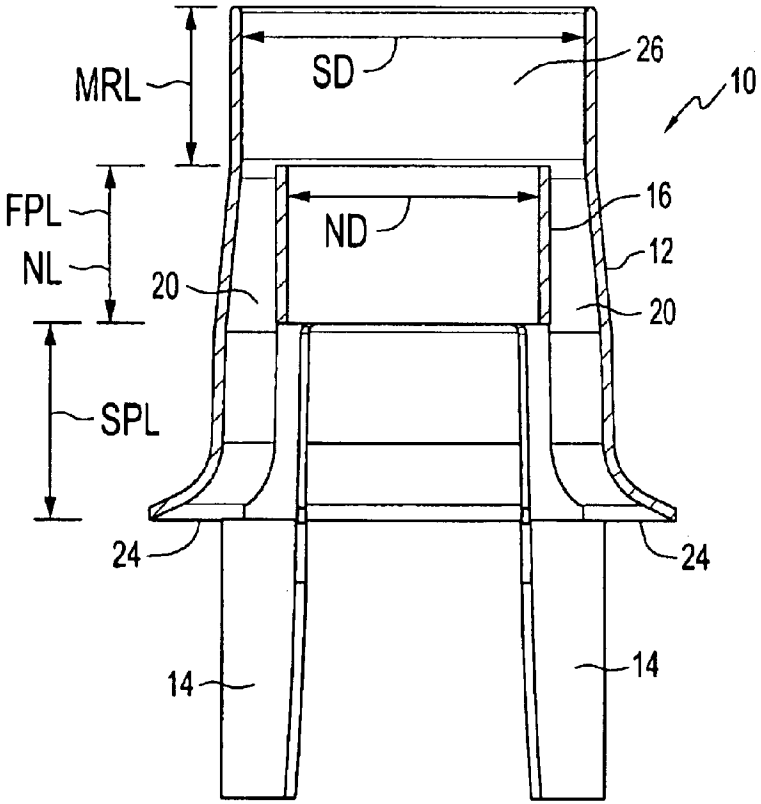
FIG. 3 is a cross section of the first exemplary attachment viewed along the line 3—3 of FIG. 1 and in the direction indicated generally.
Figure 5:
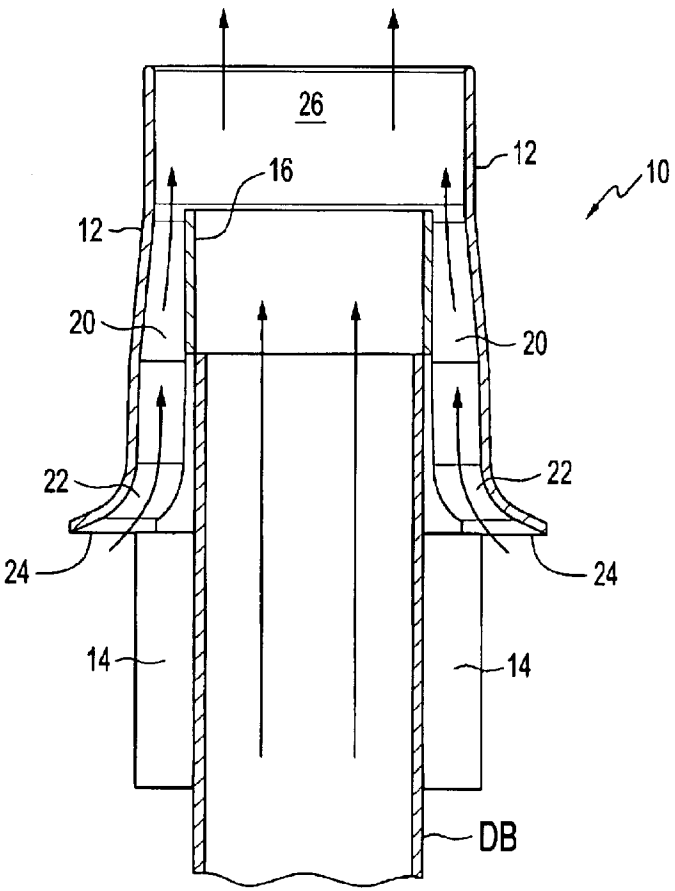
FIG. 5 is a cross section of the first exemplary attachment of the invention installed on a dryer barrel.

As best shown by the cross sections of FIGS. 3 and 5, a generally cylindrical nozzle 16 is contained within and is secured to the shell 12. As such, the nozzle 16 has a diameter that is less than a diameter of the shell 12. In the exemplary embodiment, the nozzle 16 is connected to the shell 12 by a plurality of spaced apart ribs 18 as can be best seen in FIG. 1. Preferably, the ribs 18 are continuous with the fins 14, although separate ribs 18 and fins 14 are also contemplated. The ribs 18 or equivalent structures support the nozzle 16 in a relatively concentric position within the generally tubular shell 12.

The fins 14 are configured for positioning a dryer barrel adjacent to the nozzle 16, and for attaching the shell 12 to the dryer barrel so that the barrel extends to about midway along the length of the shell 12. Accordingly, a portion of the shell 12 is coextensive with the dryer barrel. As used herein, the term "coextensive" is intended to broadly refer to a general condition of having lengths that overlap one another. Other exemplary invention embodiments may include barrel-receiving members in addition to or as an alternative to the fins 14. One or more adjustable clamps or rings, for example, could be provided. Preferably, the fins 14 or other equivalent receiving member are configured to removably attach the shell 12 to the dryer barrel without substantially impeding flow-through the barrel.

Referring now to FIGS. 3 and 5, a first or upper passage 20 is defined between the nozzle 16 and the shell 12, and a second or lower passage 22 is defined between the shell and a dryer barrel DB when the attachment 10 is installed on the barrel DB. For purposes herein, "upper" and "lower" and "first" and "second" are being used with reference to the passages 20 and 22 as configured and oriented in the attachment 10 as shown. It will be understood that the terms "upper," "lower," "first," and "second," are not intended to limit the invention, and that other operational orientations may be achieved. For example, if the orientation of the attachment were reversed, "upper" and "lower" could of course likewise be reversed. Also, the terms "first" and "second" could be used to describe either of the passages 20 or 22 in other invention embodiments. It will also be appreciated that the barrel DB has been illustrated in order to more fully explain operation of embodiments of the present invention, but that the barrel DB is not a part of the present invention.

Figure 6:
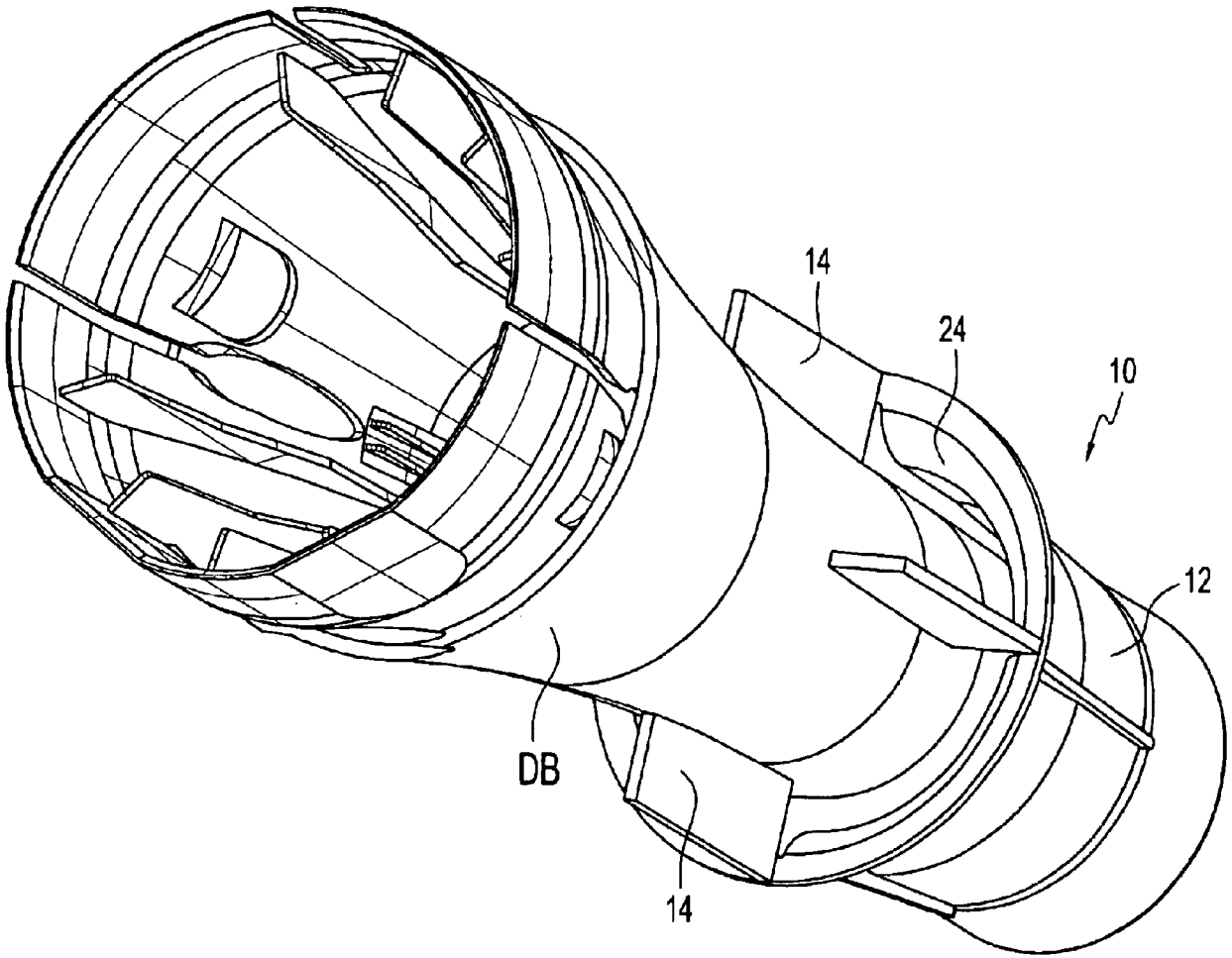
FIG. 6 is a perspective view of the first exemplary attachment installed on a dryer barrel viewed generally along the attachment inlet.

The upper and lower passages 20 and 22 are in communication with one another, and the lower passage 22 terminates in a shell inlet 24 that is open to the atmosphere when the attachment 10 is installed on the dryer barrel DB, as best shown by FIGS. 5–6. The lower passage 22 generally narrows from the shell inlet 24 to the second passage 20. In the exemplary attachment 10, the inlet 24 is substantially flared and is larger than a distal shell outlet 25. The shell 12 further defines a mixing region 26 downstream of the nozzle 16 in which air flowing from the dryer barrel DB and the nozzle 16 mixes with ambient air that has been communicated through the upper and lower passages 20 and 22 from the shell inlet 24. The shell inlet 24 is larger in area than the area of the dryer barrel outlet BO. The mixing region 26 has a diameter that is much larger than the width of the upper passage 20.

Figure 7:
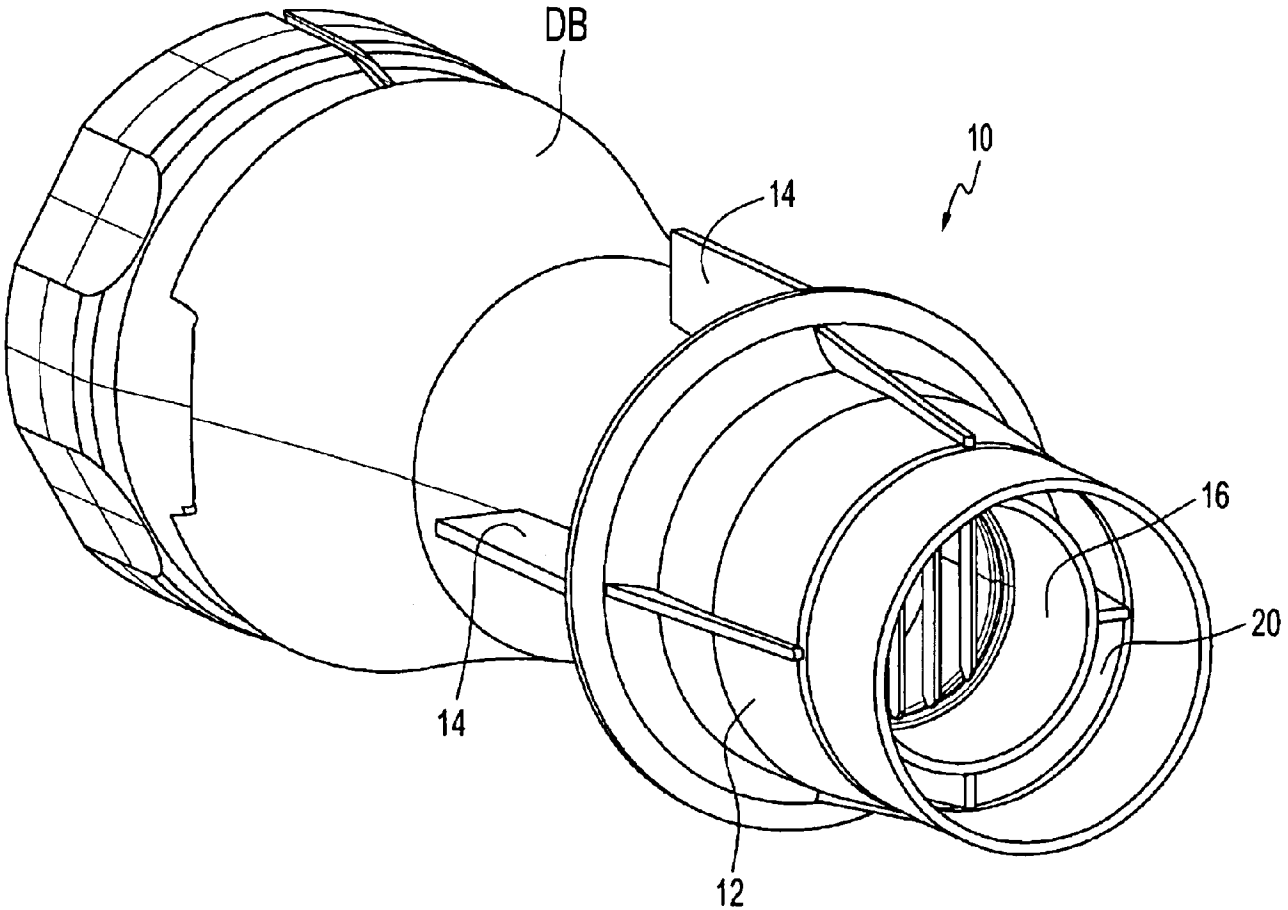
FIG. 7 is a perspective view of the first exemplary attachment installed on a dryer barrel viewed generally along the attachment outlet.
Figure 8:
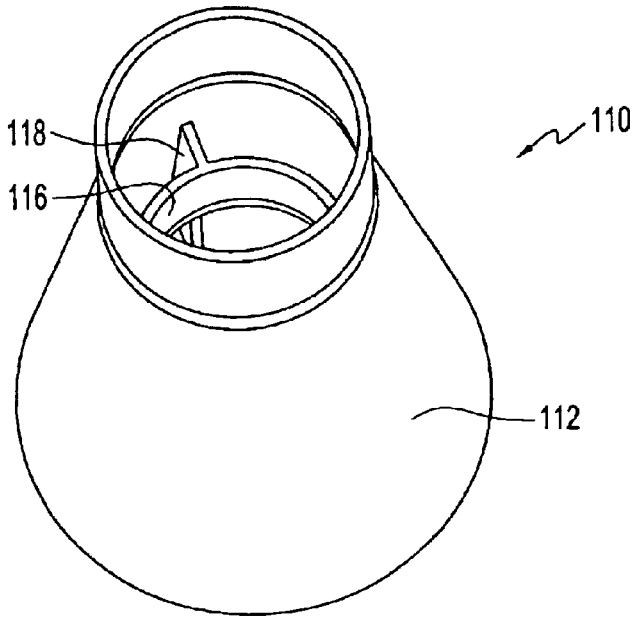
FIG. 8 is a perspective view of a second exemplary attachment of the invention viewed generally along the attachment outlet.
Figure 9:
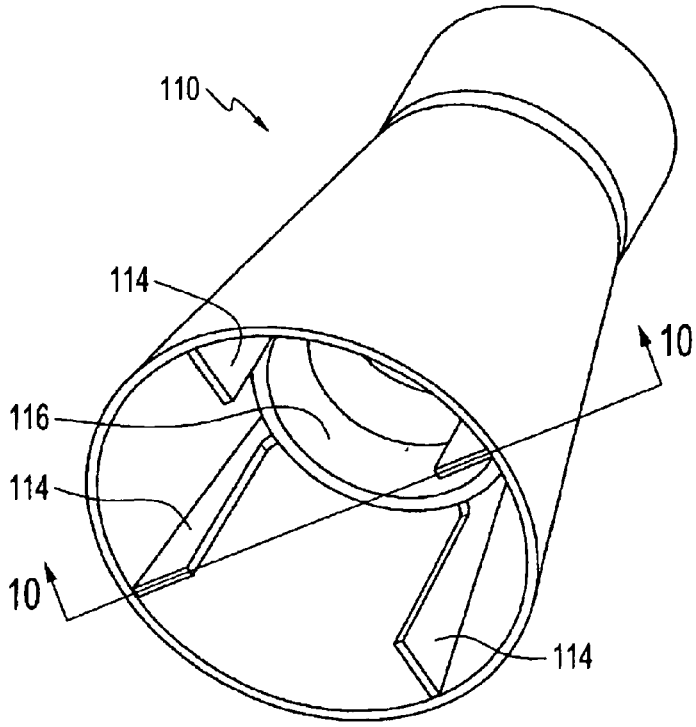
FIG. 9 is a perspective view of the second exemplary attachment of the invention viewed generally along the attachment inlet.

In operation, the attachment 10 is operable when attached to a dryer to increase the volumetric flow of useful air for drying. Generally, and with reference to FIGS. 5–7 by way of illustration, air exits the dryer barrel DB, passes through the nozzle 16, and flows through the mixing region 26. As the air passes through the mixing region 26, a pressure differential is created as described by the well-known Venturi effect that causes air to flow into the mixing region 26 from the passages 20 and 22 and the shell inlet 24. The air drawn into the inlet 24 is communicated through the passages 20 and 22 to mix with the air from the dryer barrel outlet BO in the mixing region 26, and travels out of the shell 12 along with the air from the dryer. Accordingly, the total volumetric air flow exiting the shell 12 is the sum total of the air urged out of the dryer and the air drawn into the mixing chamber 26 from the shell inlet 24.

It will be appreciated that the amount of volumetric flow that exits the attachment 10 will vary depending on such factors as the performance of the dryer being used, the length, shape and diameter o the shell 12, the length, shape and diameter of the nozzle 16, and the like. With reference to FIG. 3 by way of illustration, in the exemplary attachment 10, the inner diameter ND of the nozzle 16 outlet is substantially the same size as the barrel outlet diameter BD. Also, the shell 12 as an outlet diameter SD that is larger than the barrel diameter BD by a factor of about 1.1 to result in a shell outlet area that is about 20% larger than the barrel outlet area. Preferably, the shell 12 has a minimum cross sectional area that is at least about 20% larger than the barrel outlet area. The mixing region 26 has a length MRL of at least about 1 in., the nozzle 16 has a length NL (equal to the upper passage 20 length FPL) of at least about 1 in., and the lower passage 22 has a length SPL of at least about 1 in. The width of the first gap 20 that spans between the shell 12 and the nozzle 16 is at least about ⅛ in.

It has been discovered that the exemplary attachment 10 with these dimensions when used with a typical commercial dryer delivers an increased volumetric flow of about 30% as compared to the dryer when operating without the attachment 10. Increasing the length dimensions MRL, FPL, and SPL within a range of about 1 additional inch each has been found to not change the volumetric flow substantially, while shortening any of the dimensions below about 1 inch has been found to decrease the volumetric flow.

It is believed that a total cumulative length of the upper and lower passages (FPL+SPL) of at least about 2 inches is beneficial to promote relatively smooth airflow into the mixing region 26. Shorter cumulative lengths have been found to decrease total volumetric flow. It is believed that these shorter lengths cause a decreased volumetric flow because they result in a less orderly flow pattern in the nozzle upper and lower passages. Also, narrowing the nozzle diameter and/or the shell diameter SD has been found to decrease the volumetric flow, while enlarging the diameters SD and ND has been found to not result in appreciable flow increases.

It will be appreciated that although these dimensions have been found to be useful for practice of an invention embodiment, other invention embodiments will have different dimensions. Further, it will be understood that although the elements of the attachment 10 have particular shapes, other invention embodiments will have different shapes. Indeed, it may be desired to vary the shape and/or the dimensions of one or more elements to affect the utility of an attachment embodiment.

Figure 10:
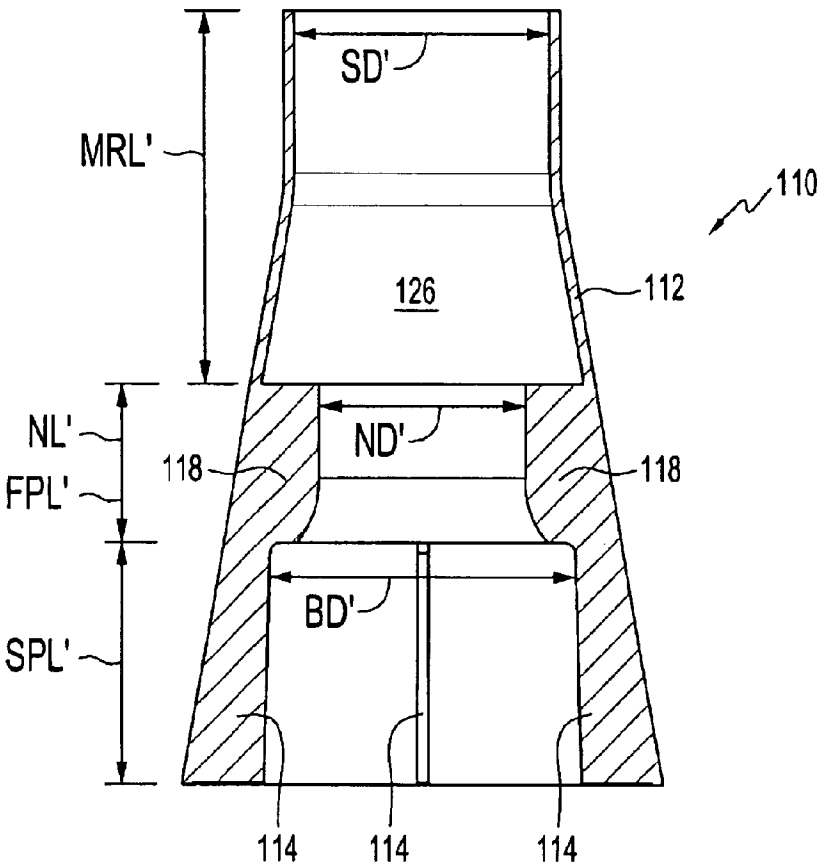
FIG. 10 is a cross section of the second exemplary attachment viewed along the line 10—10 of FIG. 9 and in the direction generally indicated.
Figure 11:
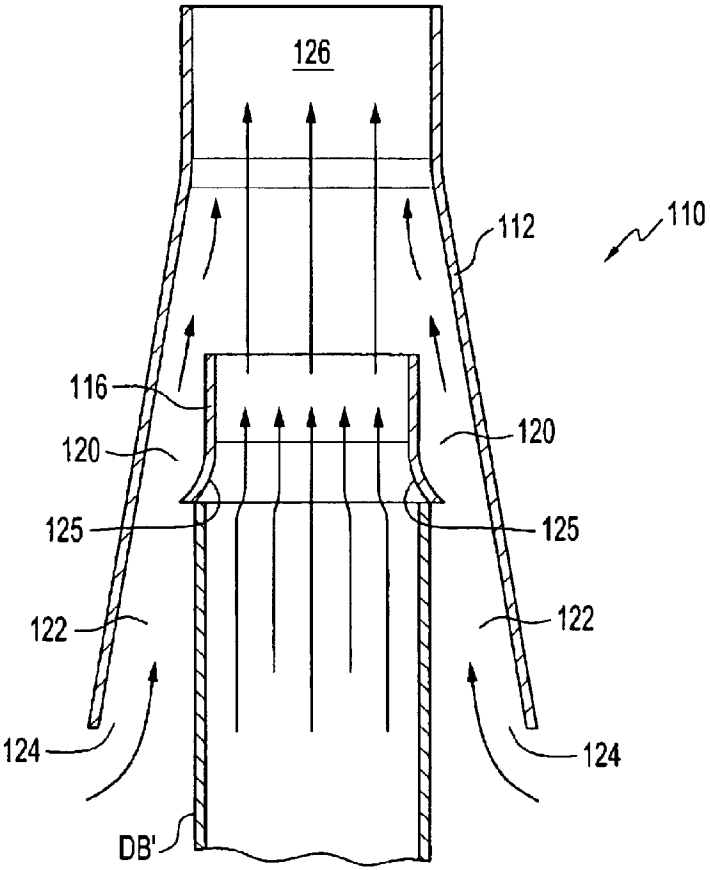
FIG. 11 is a cross section of the second exemplary attachment embodiment installed on a dryer barrel.
Figure 12:
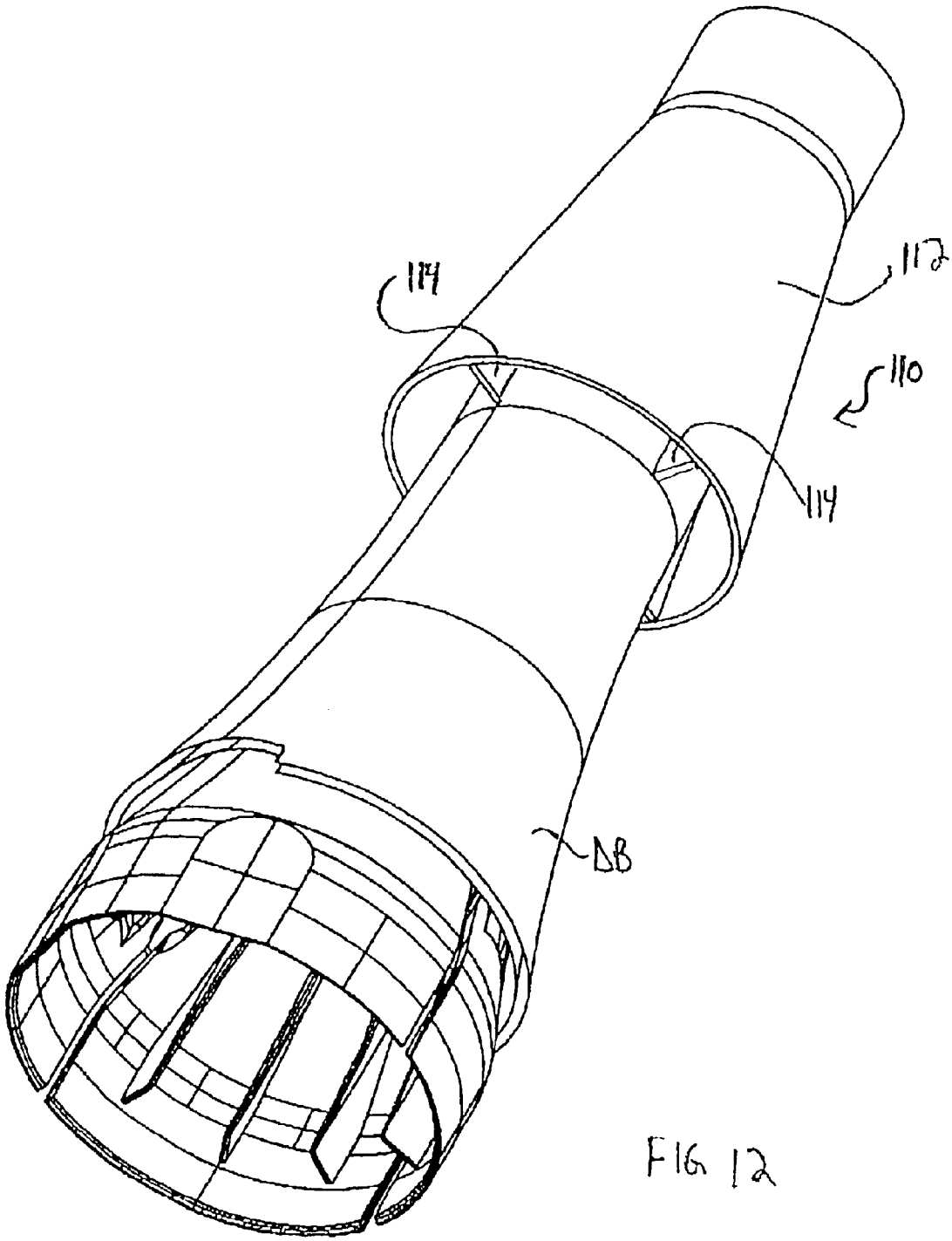
FIG. 12 is a perspective view of the second exemplary attachment installed on a dryer barrel.
Figure 12:
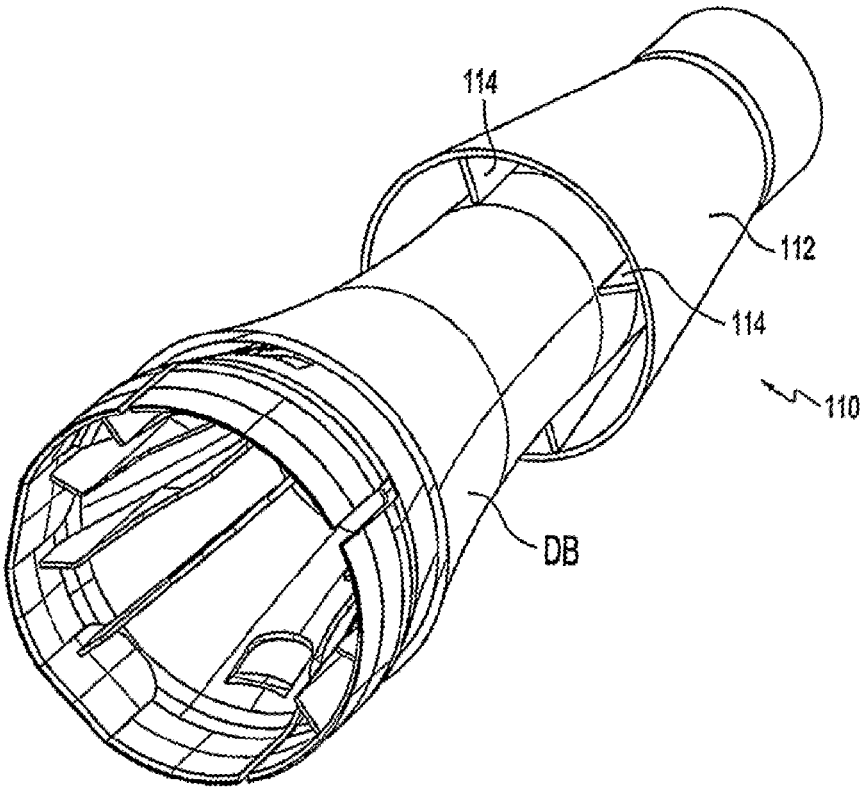

Referring now o FIGS. 8–12, a second exemplary attachment 110 of the invention is shown. Because the second exemplary attachment 110 is similar in many respects to the first exemplary attachment 10, 100 series element numbers have been used to describe corresponding elements for clarity. The attachment 110 includes a generally tubular shaped shell 112 that contains a nozzle 116. The shell 112 has the general shape of a frustum with a cylindrical shaped tube proximate its outlet. A plurality of fins 114 connected to the shell 112 extend to an inlet end and are configured to removably and frictionally attach the shell to a dryer barrel. As best s own in the views of FIGS. 8–11, the nozzle 116 is connected thereto by a plurality of spaced part ribs 118 that are preferably continuous with the fins 114. The nozzle 116 is generally cylindrical shaped, with a tapered inlet 125. As best shown by FIGS. 11–12, the plurality of fin 114 are configured to position a dryer barrel DB' adjacent to the nozzle inlet 125.

As best shown by the cross section of FIG. 11, a first or upper passage 120 is defined between the shell 112 and the nozzle 116, and a second or lower passage 122 between the shell and the dryer barrel DB'. In the exemplary embodiment, the upper and lower passages 120 and 122 are in communication with one another, and the lower passage 122 terminates in the shell inlet 124. Also, the exemplary embodiment 110 includes a shell inlet 124 that has an area larger than the dryer barrel outlet BO'. The lower passage 122 generally narrows from the shell inlet 124 to the second-passage 120. The shell 112 further defines a mixing region 126 downstream of the nozzle 116.

In operation the attachment 110 directs air expelled from the dryer barrel DB' through the nozzle 116 and into the mixing region 126 in the general direction shown by the arrows A in FIG. 11. As the air passes from the nozzle 116 and through the mixing region 126, the Venturi effect causes a pressure drop that draws air in along the general direction of the arrows B extending through the passages 120 and 122 and the shell inlet 124. The air from the inlet 124 mixes with the air from the nozzle 116 in the mixing region 126, and is directed out of the attachment 110. Operation of the attachment 110 is therefore generally consistent with operation of the attachment 10 of FIGS. 1–7.

The particular configuration of the attachment 110, however, affects its performance so that different operational results are obtained as compared to the first exemplary attachment 10. Generally, the attachment 110 has been configured to favor achieving increased air velocity over increased volumetric flow rate. With reference to FIG. 10, the nozzle inlet 125 is tapered and necks down from a size sufficient to mate with the dryer barrel DB', so that the nozzle 116 outlet diameter ND' is smaller than the barrel outlet diameter BD'. This results in an increase in velocity of the air exiting the nozzle 116 over the air exiting the dryer barrel DB'. The amount of the difference in diameter may be adjusted to provide a suitable velocity increase. For the exemplary attachment 110, the nozzle outlet diameter ND' is about 1.25 in., while the barrel outlet diameter BD' is about 1.375 in. This results in an area difference of about 20%. It is believed that an area of the nozzle 116 outlet that is between about 15% and 25% smaller than the barrel outlet area will be most useful for practice of exemplary invention embodiments directed to increasing air velocity. However, variations in the above dimensions may still provide the perceived beneficial results.

In the attachment 110, the shell outlet diameter SD' has been provided at about equal to the size as the barrel outlet diameter BD'. Although it is believed that small variations in the diameter SD' do not affect the function of the attachment 110 to increase air velocity, it has been discovered that significantly increasing the diameter SD' as compared to the barrel outlet diameter BD' causes the velocity of output air to decrease.

In the exemplary attachment 110, the mixing region 126 length MRL' is about 2 inches, the nozzle 116 length NL' (as well as the upper passage length 'FPL') is about 0.75 inches, and the lower passage length 'SPL' is about 1.375 in. With these exemplary dimensions, the attachment 110 as been found to provide an increase in air velocity of at least about 10–20% over a typical dryer operating without the attachment 110. The attachment 110 also provides an increase in volumetric airflow, although it is not as significant as the increase provided by the attachment 10.

Still an additional advantage of attachments of the invention is that they have been discovered to only marginally increase the load on a dryer motor when installed on the motor. For example, when the attachment embodiments 10 and 110 were attached to a hair dryer operating at about 15,000 RPM, the dryer motor increased in speed by only about 0.3%. The increase in motor speed will vary depending on factors such as the dryer dimensions, the motor speed and power, the attachment dimensions, and the like. It is believed, however, that the attachments of the invention should result in motor speed increases of less than about 1% for typical hair dryers. More preferably, motor speed should increase by less than about 0.5%. Advantageously, this allows for attachments of the invention to be used with negligible increased load on a dryer motor.

Other variations on the shapes and sizes of attachments of the invention in addition to those shown and discussed herein will be obvious to those knowledgeable in the art. Manipulation of element sizes and attachment configurations may be made to suit a particular application. For example, the diameter and shape of an attachment nozzle and a shell outlet may be varied to vary air volumetric and velocity output.

Other variations may also be made to suit the needs of a particular application that are not directed to volumetric or velocity output alteration. By way of additional example, when considering FIGS. 6–7 and 12, it will be appreciated that the fins 14 and 114 have been provided in a configuration for fitting the particular geometry of the dryer barrel to which they are attached. Other invention embodiments may be provided with adjustable barrel-receiving members as alternatives to the fins 14 and 114 so that an attachment of the invention may be attached to barrels of different geometries. For example, a pliable material such as soft rubber or polymer layer may be provided on fins or other members to provide some tolerance for barrels of different diameters. Additionally, receiving members such as an adjustable clamp or ring may be provided. The barrel receiving member may also not be directly connected to the shell, but instead may be indirectly connected though another member, such as the nozzle. As used herein, the term "linked" will be understood to include such an indirect connection.

Those skilled in the art will further appreciate that the presently described exemplary attachment embodiments described herein have been discussed for illustration purposes only. Other embodiments are of course possible within the scope of the invention. For example, those knowledgeable in the art will additionally appreciate that some invention embodiments will be of utility that do not include all of the elements of the attachments 110 and 112. It is believed, for instance, that an invention embodiment that did not include a nozzle could be of utility in some applications. In such an embodiment, however, it is believed that the attachment shell would be required to extend further back along the dryer barrel so that air drawn into the mixing chamber had a relatively smooth flow pattern.

Various features are set forth in the appended claims.

What is claimed is:

1. An attachment for a handheld dryer of the type that has a barrel through which air flows, the attachment comprising:

a shell at least partially coextensive with the barrel, a passage being defined between said shell and the barrel, an inlet being defined between said shell and the barrel, said passage communicating with said inlet; and, at least one barrel-receiving member linked to said shell and operative to attach said shell to the barrel, and wherein the attachment when installed on the dryer causes the motor RPM to increase by less than about 1% and increases volumetric air flow from the dryer by at least about 30% as compared to the dryer without the attachment.

2. The attachment of claim 1 wherein the shell is generally tubular shaped and has an unobstructed, generally circular outlet.

3. The attachment of claim 1 wherein the barrel has an outlet area, and wherein said shell has an outlet area larger than the barrel outlet area.

4. The attachment of claim 1 wherein the attachment causes the motor RPM to increase by less than about 0.5% when the attachment is installed on the dryer.

5. The attachment of claim 1 wherein said at least one barrel-receiving member comprises a plurality of spaced apart elongated fins configured for frictionally receiving the barrel, said fins connected to said shell.

6. The attachment of claim 1 wherein said at least one barrel-receiving member is adjustable for receiving barrels of different diameters.

7. The attachment of claim 1 wherein said at least one barrel receiving member is configured to removably attach said shell to the dryer barrel without substantially impeding air flow through the barrel.

8. The attachment of claim 1 wherein said passage generally narrows from an inlet.

9. The attachment of claim 1 wherein said shell has an outlet, and further defines a mixing region proximate to said outlet and communicating with said passage.

10. The attachment of claim 9 wherein said mixing region has a length of at least about 1 inch, and a diameter larger than the width of said passage.

11. The attachment of claim 1 wherein said passage comprises a first passage, and further comprising a nozzle contained in said shell, a second passage being defined between said s hell and said nozzle, s aid second passage communicating with said first passage.

12. The attachment of claim 11 wherein said first passage and said second passage have a combined length of at least about 1 inch.

13. The attachment of claim 12 wherein said combined length of said first and second passages is at least about 2 inches.

14. The attachment of claim 11 wherein said nozzle is connected to said shell by a plurality of spaced apart ribs.

15. The attachment of claim 11 wherein said nozzle is substantially cylindrical shaped, and has a diameter substantially the same size as the barrel diameter.

16. The attachment of claim 1 wherein said barrel receiving members are configured to attach said shell to the dryer barrel so that the dryer barrel extends to about midway along the length of said shell.

17. The attachment of claim 1 wherein the barrel has an outlet area and wherein said shell has a minimum cross sectional area that is at least about 20% larger than the barrel outlet area.

18. An attachment for a handheld hairdryer of the type that has a barrel for dire ting an air flow through a barrel outlet, the barrel outlet having an area, the attachment comprising:

a generally tubular shell having at least one fin as a barrel receiving member configured to removably attach said shell to a portion of the dryer barrel, said shell being at least partially coextensive with the barrel, said shell having an inlet larger in area than the barrel outlet area, said shell having an unobstructed outlet with an area smaller than said shell inlet area;

a generally cylindrical nozzle contained in said shell, said at least one barrel receiving member configured for positioning the barrel outlet adjacent to said nozzle;

a first passage defined between said nozzle and said shell;

a second passage defined between said shell and the barrel and terminating at said shell inlet, said second passage communicating with said first passage, said first and second passages having a combined length of at least about 1 inch; and a mixing region defined within said shell downstream of said nozzle, said mixing region communicating with said first and second passages and said shell inlet, said mixing region having a length of at least about 1 inch.

19. An attachment as in claim 18 wherein the barrel has an outlet area, said nozzle has an outlet with an area that is substantially the same size as the barrel outlet area, and wherein said shell has an outlet with an area that is larger than the barrel outlet area.

20. An attachment for a dryer with a barrel, the attachment comprising:

a generally cylindrical nozzle configured for engaging the barrel of the dryer;

a shell at least partially coextensive with said nozzle;

a mixing region defined within said shell and downstream of said nozzle; and, at least one passage defined between said nozzle and said shell and terminating in said mixing region;

said passage is generally tapered from said passage inlet to said mixing region and has a substantially flared inlet at least partially defined by said shell; and a plurality of spaced apart elongated fins linked to said shell and operative to attach said shell to the barrel, and wherein said plurality of spaced apart elongated fins are configured for frictionally receiving the barrel as the only fastening structure for securing said shell to the barrel.

21. An attachment for a dryer as defined by claim 20 wherein said passage extends between a passage inlet and said mixing region, and wherein said mixing region has a length of at least about 1 inch.

22. An attachment for a dryer as defined by claim 20 wherein the barrel has an outlet with a diameter, and wherein said nozzle is substantially cylindrical shaped and has a diameter substantially the same size as the barrel diameter.

* * * * *

UNITED STATES PATENT AND TRADEMARK OFFICE

CERTIFICATE OF CORRECTION

PATENT NO. : 6,957,500 B2
APPLICATION NO. : 10/286592
DATED : October 25, 2005
INVENTOR(S) : James E. McCambridge et al.

It is certified that error appears in the above-identified patent and that said Letters Patent is hereby corrected as shown below:

In the Issued Patent:

On the Title Page of the Patent (under a new section entitled "Other Documents"), please insert the following:

--"*Vortex Jet Speed Hair Dryer*," product manual, published by Remington Products Corporation, LLC, Bridgeport, CT, believed published August of 2000"--.

In the Drawings:

Please replace informal drawing Figure 12 with the formal drawing Figure 12 that was filed on April 28, 2003.

In the Specification

Column 3, line 12, delete "flow-through" and insert --flow through-- therefore.

Column 3, line 67, delete "o" and insert --of-- therefore.

Column 4, line 47, delete "o" and insert --to--therefore.

Column 4, line 62, delete "fin" and insert --fins-- therefore.

In the Claims:

Column 7, line 32, delete "s hell" and insert --shell-- therefore.

Column 7, line 32, delete "s aid" and insert --said-- therefore.

UNITED STATES PATENT AND TRADEMARK OFFICE

CERTIFICATE OF CORRECTION

PATENT NO. : 6,957,500 B2
APPLICATION NO. : 10/286592
DATED : October 25, 2005
INVENTOR(S) : James E. McCambridge et al.

It is certified that error appears in the above-identified patent and that said Letters Patent is hereby corrected as shown below:

In the Claims: (cont'd)

Column 7, line 54, delete "dire ting" and insert --directing-- therefore.

Signed and Sealed this

Fifteenth Day of May, 2007

JON W. DUDAS
*Director of the United States Patent and Trademark Office*